US007775828B2

(12) United States Patent
Zhang

(10) Patent No.: US 7,775,828 B2
(45) Date of Patent: Aug. 17, 2010

(54) ELECTRICAL CONNECTOR HAVING IMPROVED GROUNDING MEMBER

(75) Inventor: Hong-Bo Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,325

(22) Filed: Dec. 11, 2008

(65) Prior Publication Data

US 2009/0149043 A1 Jun. 11, 2009

(30) Foreign Application Priority Data

Dec. 11, 2007 (CN) ..... 2007 2 0131356 U

(51) Int. Cl.
*H01R 13/60* (2006.01)

(52) U.S. Cl. ..... 439/540.1

(58) Field of Classification Search ..... 439/676, 439/541.5, 541.1, 607.01, 701
See application file for complete search history.

(56) References Cited

U.S. PATENT DOCUMENTS 6,132,260 A * 10/2000 Wu ..... 439/676
6,511,348 B1 1/2003 Wojtacki et al.
6,729,906 B1 * 5/2004 Simmons et al. ..... 439/607.26
7,033,210 B1 * 4/2006 Laurer et al. ..... 439/541.5
7,074,083 B2 * 7/2006 Hyland ..... 439/607.01

* cited by examiner

*Primary Examiner*—Jean F Duverne
(74) *Attorney, Agent, or Firm*—Ming Chieh Chang; Wei Te Chung; Andrew C. Cheng

(57) ABSTRACT

An electrical connector (1) mounted on a mother printed circuit board (2) includes an insulative housing (3), a contacting module (4) having a pair of daughter printed circuit boards (42), a grounding member (6) and an outer shield (5) enclosing the insulative housing. The grounding member has a base portion (61) connecting to the daughter printed circuit board and a contacting portion (62) extending downwardly for connecting with the mother printed circuit board. The outer shield has a protruding member (522) for contacting with the grounding member and a number of tines (53) extending downwardly therefrom in contact with the mother printed circuit board for grounding.

14 Claims, 4 Drawing Sheets

ELECTRICAL CONNECTOR HAVING IMPROVED GROUNDING MEMBER

BACKGROUND OF THE INVENTION

1. Field of the Invention

The present invention relates to an electrical connector, and particularly to an electrical connector having a grounding member forming a plurality of grounding circuits for eliminating interference caused by static electricity thereby ensuring reliable signal transmission between the connector and a mating connector.

2. Description of the Prior Art

A conventional modular connector mounted onto a printed circuit board comprises an insulative housing and an outer shield enclosing the insulative housing. The outer shield has a plurality of openings therethrough for engaging with corresponding plug connector and a plurality of pins extending downwardly for grounding contact with the printed circuit board. The electrical magnetic interference could not be effectively reduced by only one grounding trace established between the pins of the outer shield and the printed circuit board.

Hence, an improved electrical connector is needed to solve the above problem.

BRIEF SUMMARY OF THE INVENTION

One object of the present invention is to provide an electrical connector having a grounding member forming a plurality of grounding circuits for effectively reducing electrical magnetic interference.

The present invention provides an electrical connector mounted on a mother printed circuit board comprises an insulative housing having at least two openings therethrough, a contacting module mounted to the insulative housing and having a pair of daughter printed circuit boards, a grounding member and an outer shield enclosing the insulative housing. The grounding member includes a base portion connecting to the daughter printed circuit board and a contacting portion extending downwardly from the base portion and connecting with the mother printed circuit board. The outer shield comprises a protruding member extending inwardly for electrically contacting with the grounding member and a plurality of tines extending downwardly therefrom in contact with the mother printed circuit board for grounding.

Advantages of the present invention are to provide a first grounding circuit established between the outer shield and the mother printed circuit board via the grounding member, and a second grounding circuit established between the outer shield and the mother printed circuit board via the tines formed on the outer shield. It is effective to reduce the electrical magnetic interference via the first and the second grounding circuits.

Other objects, advantages and novel features of the invention will become more apparent from the following detailed description of the present embodiments when taken in conjunction with the accompanying drawings.

DETAILED DESCRIPTION OF THE INVENTION

Figure 1:
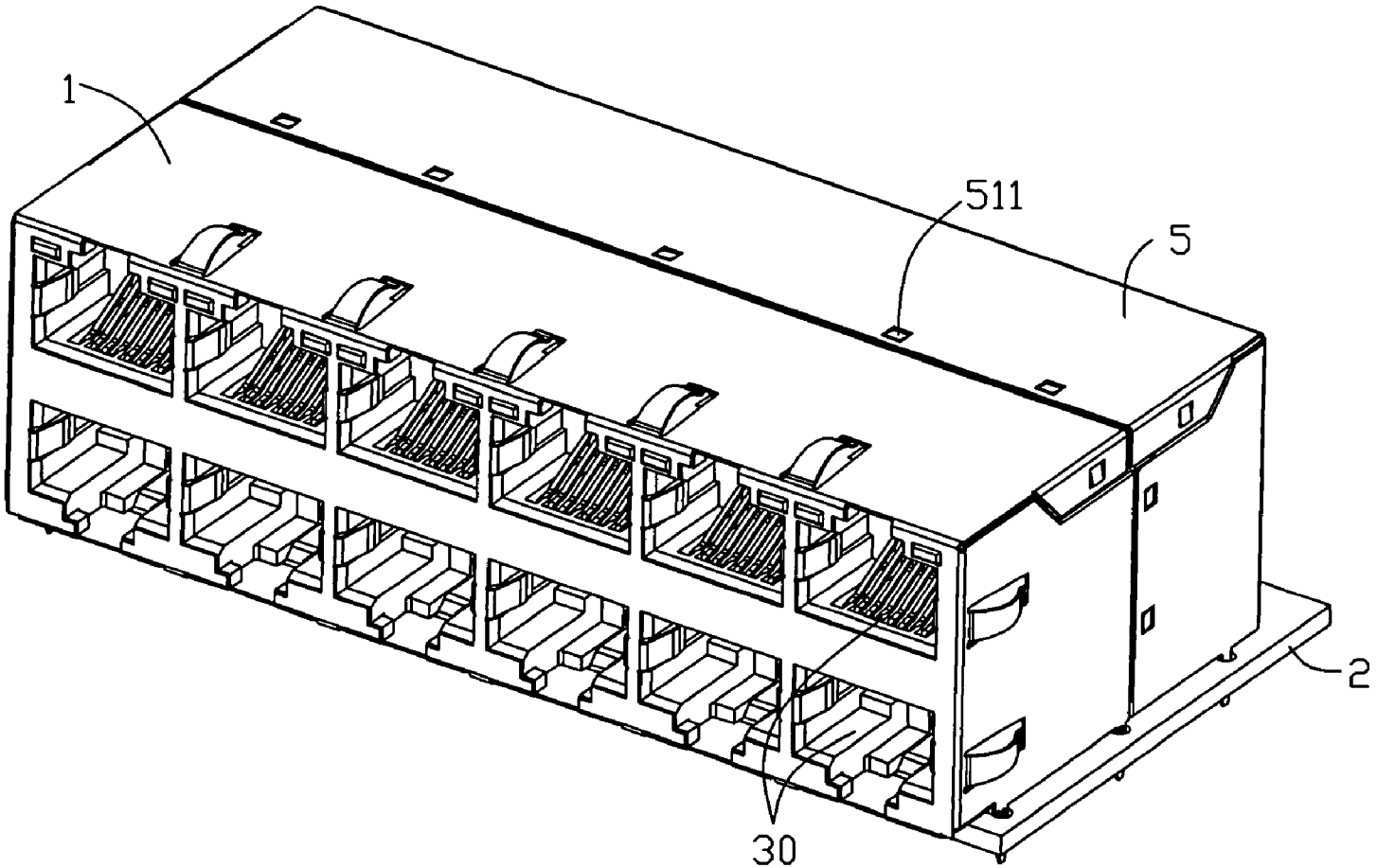
FIG. 1 is an assembled perspective view of an electrical connector mounted to a mother printed circuit board according to the present invention.
Figure 2:
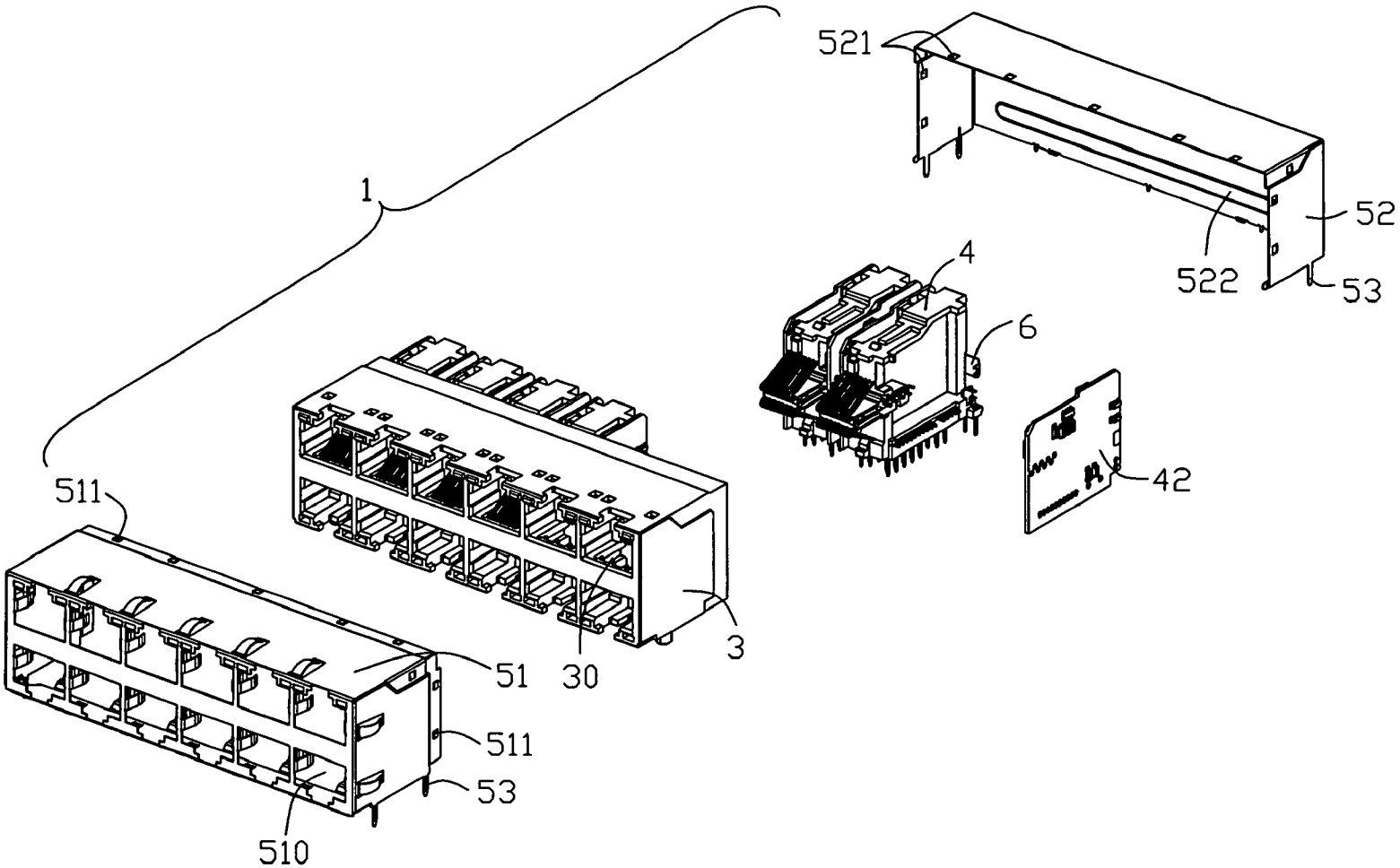
FIG. 2 is an exploded view of the electrical connector as shown in FIG. 1.

Reference will now be made to the drawing figures to describe the pre-sent invention in detail. Referring to FIGS. 1-2, an electrical connector 1 mounted onto a mother printed circuit board 2 in accordance with the present invention comprises an insulative housing 3, a plurality of contacting modules 4 mounted into the insulative housing 3, a grounding member 6 assembled to the contacting module 4 and an outer shield 5 enclosing the insulative housing 3.

As shown in FIG. 2, the insulative housing 3 has two arrays of openings 30 profiled one above the other for receiving mating plugs (not shown).

Figure 3:
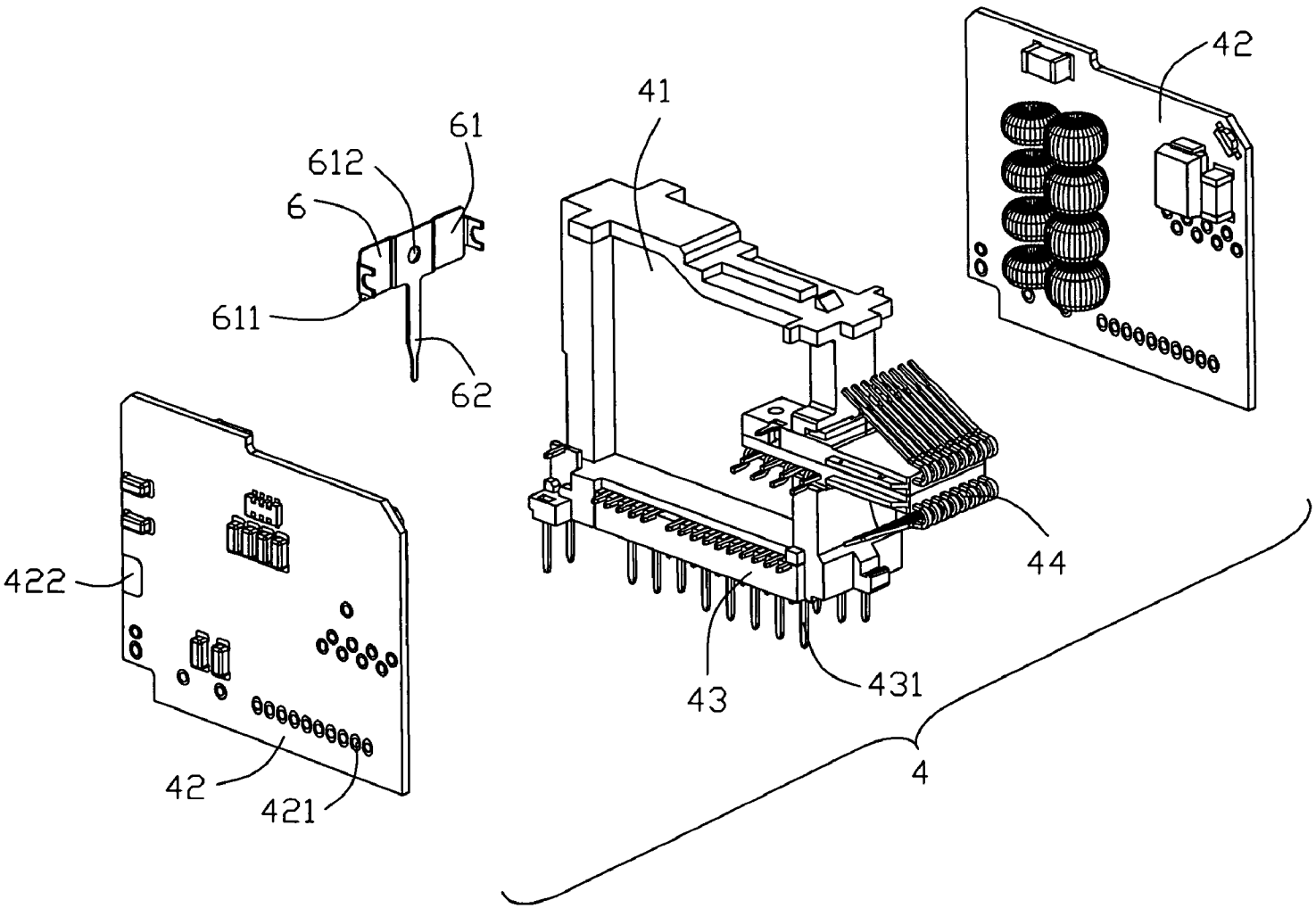
FIG. 3 is an exploded view of a contacting module and a grounding member.
Figure 4:
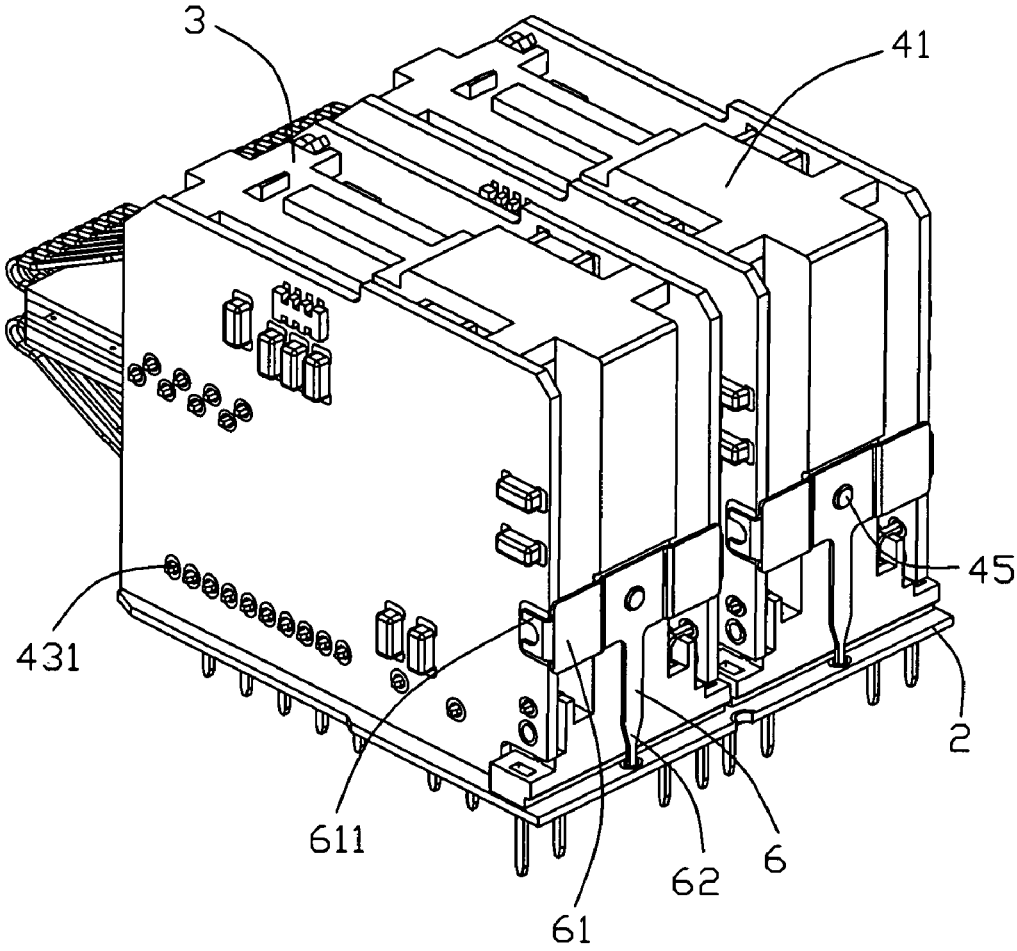
FIG. 4 is a perspective view showing the grounding member mounted to the contacting module.

As shown in FIGS. 3 and 4, the contacting module 4 includes a medial element 41, a terminal element 44 mounted to a front portion of the medial element 41 for engaging with corresponding mating plug, a pair of daughter printed circuit boards 42 mounted to opposite sides of the medial portion 41 and a connecting element 43 assembled to a bottom portion of the medial element 41 for connecting with the mother printed circuit board 2. The connecting element 43 has a plurality of contacts 431 extending through corresponding holes 421 defined in the daughter printed circuit board 42.

As shown in FIGS. 3 and 4, the outer shield 5 has a front shield 51 having a plurality of protrusions 511 disposed thereon and a rear shield 52 having a plurality of receiving aperture 521 for receipt of the protrusions 511. The front shield 51 comprises a plurality of cavities 510 in alignment with said openings 30. The rear shield 52 has a protruding member 522 extending inwardly for electrically contacting with the grounding member 6 and a plurality of tines 53 extending downwardly and in contact with the mother printed circuit board 2 for grounding.

The grounding member 6 is of T-shaped configuration and has a base portion 61, a contacting portion 62 extending downwardly from the base portion 61 and connecting with the mother printed circuit board 2. The base portion 61 of the grounding member 6 has a pair of bending portions 611 extending perpendicularly from opposite end portions thereof for engaging with a pair of corresponds pads 422 respectively disposed on the daughter printed circuit board 42. A hole 612 is defined on the base portion 61 for mating with a post 45 disposed on a rear portion of the medial element 41.

Referring to FIGS. 1-4, In assembling of the electrical connector 1, firstly, the grounding member 6 is mounted to the medial element 41 by the engagement between the hole 612 and the post 45 of the medial element 41. The pair of bending portions 611 contacts with the corresponding pads 422 of the daughter printed circuit board 42. Secondly, the contacting modules 4 are retained in the insulative housing 3. Finally, the outer shield 5 encloses the insulative housing 3. The protruding member 522 of the shield 5 electrically contacts with the grounding member 6 and the contacting portions 62 contact with the mother printed circuit board 2 to form a first electrical circuit for grounding. The tines 53 of the outer shield 5 connect to the mother printed circuit board 2 to form a second electrical circuit for grounding.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for mounting on a mother printed circuit board, comprising:

an insulative housing having at least two openings therethrough for receiving corresponding electrical plugs;

a contacting module mounted to the insulative housing and comprising a pair of daughter printed circuit boards;

a grounding member having a base portion connecting to the daughter printed circuit board at a first position and a contacting portion extending downwardly from the base portion and connecting with the mother printed circuit board at a second position, the first and the second positions being located adjacent to a rear side of the daughter printed circuit board; and an outer shield enclosing the insulative housing and having a protruding member extending inwardly for electrically contacting with the grounding member and a plurality of tines extending downwardly to be in contact with the mother printed circuit board for grounding.

2. The electrical connector as claimed in claim 1, wherein each of said pair of daughter printed circuit boards has a pad disposed thereon, and said base portion of the grounding member has a pair of bending portions extending from opposite end portions thereof for engaging with the pads.

3. The electrical connector as claimed in claim 1, wherein said grounding member is of T-shaped configuration.

4. The electrical connector as claimed in claim 1, wherein said contacting module comprises a medial element, a terminal element mounted to a front portion of the medial element and a connecting element assembled to a bottom portion of the medial element for connecting with the mother printed circuit board.

5. The electrical connector as claimed in claim 4, wherein said pair of daughter printed circuit boards are mounted to opposite sides of the medial element.

6. The electrical connector as claimed in claim 4, wherein said medial element comprise a post disposed on a rear portion thereof, and the grounding member defines a hole thereon for mating with the post.

7. The electrical connector as claimed in claim 1, wherein said openings are profiled one above the other for receiving corresponding electrical plugs.

8. The electrical connector as claimed in claim 1, wherein said outer shield has a front shield having a plurality of protrusions disposed thereon and a rear shield having a plurality of receiving apertures receiving the protrusions.

9. The electrical connector as claimed in claim 8, wherein said front shield comprises a plurality of cavities in alignment with said openings.

10. An electrical connector, comprising:

a contact module including an insulative medial member having a plurality of mating terminals in a front portion thereof and a plurality of mounting terminals on a bottom portion thereof, and a pair of printed circuit board vertically standing on two lateral sides mechanically and electrically connected to said mating terminals and said mounting terminals; wherein a grounding member located at a rear portion of the medial member and fastened to the medial member with two opposite arms mechanically and electrically connected to the corresponding printed circuit boards, respectively, said grounding member having a grounding portion disposed between said two opposite arms.

11. The electrical connector as claimed in claim 1, wherein said grounding member is located in a plane orthogonal to the daughter printed circuit board and the mother printed circuit board.

12. The electrical connector as claimed in claim 10, wherein said grounding portion of the grounding member extends downwardly from a substantially central position between the two opposite arms.

13. An electrical connector for mounting to a main printed circuit board, comprising:

a contact module including an insulative medial member having a plurality of mating terminals in a front portion thereof and a plurality of mounting terminals on a bottom portion thereof for mounting to the main printed circuit board, and a pair of daughter printed circuit boards vertically standing on two lateral sides mechanically and electrically connected to said mating terminals and said mounting terminals; wherein a grounding member located upon a rear face of the medial member and fastened to the medial member with two opposite arms mechanically and electrically connected to the corresponding daughter printed circuit boards, respectively, and further with a downwardly extending contacting portion for mechanically and electrically connecting to the main printed circuit board.

14. The electrical connector as claimed in claim 13, wherein the contacting portion is located transversely between the two opposite arms.

* * * * *